US010125566B2

(12) United States Patent
Roselier et al.

(10) Patent No.: US 10,125,566 B2
(45) Date of Patent: Nov. 13, 2018

(54) ISOLATION DEVICE OF PART OF A WELL

(71) Applicant: Saltel Industries, Bruz (FR)

(72) Inventors: Samuel Roselier, Le Rheu (FR); Benjamin Saltel, Le Rheu (FR); Jean-Louis Saltel, Le Rheu (FR)

(73) Assignee: Saltel Industries (FR)

( * ) Notice: Subject to any disclaimer, the term of this patent is extended or adjusted under 35 U.S.C. 154(b) by 244 days.

(21) Appl. No.: 15/261,083

(22) Filed: Sep. 9, 2016

(65) Prior Publication Data

US 2016/0376870 A1 Dec. 29, 2016

Related U.S. Application Data

(62) Division of application No. 13/768,209, filed on Feb. 15, 2013, now Pat. No. 9,506,314.
(Continued)

(30) Foreign Application Priority Data

Mar. 16, 2012 (FR) ..... 12 52384

(51) Int. Cl.
*E21B 33/127* (2006.01)
*E21B 33/12* (2006.01)
(Continued)

(52) U.S. Cl.
CPC ..... *E21B 33/1277* (2013.01); *E21B 33/12* (2013.01); *E21B 33/126* (2013.01);
(Continued)

(58) Field of Classification Search
CPC ..... E21B 33/127; E21B 33/1277
See application file for complete search history.

(56) References Cited

U.S. PATENT DOCUMENTS 2,827,965 A 3/1958 Mounce
2,970,651 A 2/1961 Roberts
(Continued)

FOREIGN PATENT DOCUMENTS

EP 1624152 A2 2/2006
WO 2011042492 A1 4/2011

OTHER PUBLICATIONS

French Search Report dated Oct. 30, 2012.
(Continued)

*Primary Examiner* — Kenneth L Thompson
(74) *Attorney, Agent, or Firm* — Lerner, David, Littenberg, Krumholz & Mentlik, LLP

(57) ABSTRACT

An isolation of part of a well, which includes a pipe provided, along its external face, with a first external sleeve, wherein the opposite ends are connected directly or indirectly to said external face of the pipe. The pipe, first external sleeve and its ends together delimit an annular space, the wall of said pipe exhibiting at least one opening which allows it to communicate with said space, this sleeve being likely to expand and to be applied tightly against the well over an intermediate part of its length. The device also includes on the one hand, a second internal sleeve, which extends between said pipe and the first sleeve, its ends being also connected directly or indirectly to the external face of said pipe and, on the other hand, at least one communication passage between the exterior of the first sleeve and said space.

12 Claims, 10 Drawing Sheets

Related U.S. Application Data

(60) Provisional application No. 61/614,225, filed on Mar. 22, 2012.

(51) Int. Cl.

| | |
|---|---|
| ***E21B 33/126*** | (2006.01) |
| ***E21B 33/13*** | (2006.01) |
| ***E21B 34/10*** | (2006.01) |
| ***E21B 43/12*** | (2006.01) |
| ***E21B 43/14*** | (2006.01) |
| ***E21B 43/26*** | (2006.01) |

(52) U.S. Cl.

CPC ..... *E21B 33/13* (2013.01); *E21B 34/10* (2013.01); *E21B 43/12* (2013.01); *E21B 43/14* (2013.01); *E21B 43/26* (2013.01)

(56) References Cited

U.S. PATENT DOCUMENTS

| | | | | |
|---|---|---|---|---|
| 3,104,717 | A | 9/1963 | Sandlin et al. | |
| 3,502,037 | A | 3/1970 | Pickard | |
| 3,581,816 | A | 6/1971 | Malone | |
| 3,604,732 | A | 9/1971 | Malone | |
| 3,837,947 | A | 9/1974 | Malone | |
| 4,492,383 | A | 1/1985 | Wood | |
| 5,220,959 | A | 6/1993 | Vance, Sr. | |
| 6,640,893 | B1 | 11/2003 | Rummel et al. | |
| 6,752,205 | B2 * | 6/2004 | Kutac | E21B 33/127 166/187 |
| 7,347,274 | B2 * | 3/2008 | Patel | E21B 33/128 166/120 |
| 7,571,765 | B2 | 8/2009 | Themig | |
| 7,591,321 | B2 | 9/2009 | Whitsitt et al. | |
| 7,606,033 | B2 | 10/2009 | Colbert et al. | |
| 9,080,415 | B2 | 7/2015 | Hallundbæk et al. | |
| 9,506,314 | B2 * | 11/2016 | Roselier | E21B 33/12 |
| 2003/0196795 | A1 | 10/2003 | Kutac et al. | |
| 2006/0004801 | A1 | 1/2006 | Hoefer et al. | |
| 2006/0042801 | A1 | 3/2006 | Hackworth et al. | |
| 2010/0071911 | A1 | 3/2010 | Carree | |
| 2011/0266004 | A1 | 11/2011 | Hallundbaek et al. | |

OTHER PUBLICATIONS

D.S. Dreesen, Los Alamos Natl. Laboratory, "Analytical and Experimental Evaluation of Expanded Metal Packers for Well Completion Service," Society of Petroleum Engineers, 1991.

* cited by examiner

ISOLATION DEVICE OF PART OF A WELL

CROSS-REFERENCE TO RELATED APPLICATIONS

This application is a divisional of U.S. application Ser. No. 13/768,209, filed on Feb. 15, 2013, which claims priority from French Application No. 1252384, filed Mar. 16, 2012, and claims the benefit of the filing date of U.S. Provisional Patent Application No. 61/614,225 filed Mar. 22, 2012, the disclosures of which are hereby incorporated herein by reference.

FIELD OF THE INVENTION

The present invention relates to the field of well drilling It relates more particularly to an isolation device of part of a wellbore.

This invention applies especially but not exclusively to the casing of a horizontal well. This casing is called "pipe" in the remainder of the document.

This well configuration has become widespread over recent years due to novel extraction techniques.

BACKGROUND OF THE INVENTION

A horizontal well, inter alia, considerably increases the productive length and therefore the contact surface with the geological formation in which gas and/or oil is present in source rock.

In such a horizontal configuration, it is technically difficult to case and cement the annular space between the pipe and the inner wall of the well in a horizontal position. This cementing technique, used in the majority of vertical or slightly deviated wells, provides a seal between different geological zones.

The exploitation of horizontal wells, whether for stimulation or flow control, requires some zones to be isolated in the rock formation itself.

A pipe is run into the well with isolation devices at its periphery, spaced out in predetermined fashion.

The term "zonal isolation packers" is used for these devices. Between these isolation devices the pipe often has ports open or closed on demand, which enable communication between the pipe and the isolated zone of the well.

In this horizontal completion environment, hydraulic fracturing (also called "fracking") is a technique for cracking of the rock in which the pipe is set horizontally.

Fracking is carried out by injection of a liquid under pressure. This technique enables extraction of oil or gas contained in highly compact and impermeable rocks.

The injected liquid generally comprises 99% water mixed especially with sand or ceramic microballs. The rock fractures under the effect of pressure and solid elements penetrate inside fissures and keep them open when the pressure drops so that gas or oil can flow through the resulting breaches.

These days fracking is mostly carried out by using an assembly of pipes such as described above. The zones are fractured one by one so that the quantity of fluid injected can be controlled. The fluid is indeed injected in limited volumes that are spread along the well. Pressures up to 1000 bar (15000 psi) can be reached.

A key element of these fracking completions is located in the isolation and sealing device. It has to ensure perfect sealing between the zones to guarantee the quality and safety of fracking.

Indeed, if sealing not ensured, a zone could be fractured several times, creating an excessively large fracture and reaching unplanned geological zones.

During these fracking operations, isolation devices are subjected to high internal, external and differential pressures. Also, the injected fluids often have a lower temperature than that of the well, subjecting isolation devices to variations in temperature.

Several types of isolation devices are currently being used.

Hydraulic-set isolation devices "Hydraulic Packers" which utilise hydraulic pressure to compress a rubber ring via one or more pistons are being used.

This rubber ring expands radially and comes into contact with the borehole.

The U.S. Pat. No. 7,571,765 is a typical example of this type of hydraulic-set isolation device.

It is clear that when used this type of device does not properly seal a well having an ovalised cross-section.

Also, a fracture of the rock can be initiated at the packer level due to high contact pressure. Hydraulic isolation devices are also sensitive to temperature variations.

Other types of devices can be used.

In this way, mechanical isolation devices "mechanical packers" have a working principle close to that of hydraulic isolation devices, the only difference is that the compression of the rubber ring is carried out by an external tool.

Also, inflatable isolation devices (in English "inflatable packers") comprise an elastic membrane inflated by injection of liquid under pressure. After activation, the pressure is maintained in the sealing device by check valve systems.

Isolation devices based on swellable elastomer (in English "swellable packers") are composed of an elastomer which swells when placed in contact with a type of fluid (oil, water, etc.) according to formulations.

Activation of these devices is initiated by contact with fluid. It is therefore understood that diameter increase must be relatively slow so as to avoid blockage of the completion during the run in hole. As a consequence, it sometimes takes several weeks to achieve the isolation of the zone.

Other types of isolation devices are those known as "expandable" (in English "expandable packers" or "metal packers") and comprise an expandable metallic sleeve which is deformed by application of liquid under pressure (see the article SPE 22 858 "Analytical and Experimental Evaluation of Expanded Metal Packers For Well Completion Services " (D. S. Dreesen et al.-1991), U.S. Pat. Nos. 6,640,893 and 7,306,033).

Expandable isolation devices made of metal usually comprise a ductile metallic sleeve attached and sealed at its ends to the surface of a pipe. The interior of the pipe, on the one hand, and the ring defined by the external surface of the pipe and the inner surface of the expandable sleeve, on the other hand, communicate with each other. The metallic sleeve is expanded radially towards the exterior until it makes contact with the borehole, by increasing the pressure in the pipe to create an annular barrier.

Contrary to other isolation devices, sealing is not based on elastomer means only, whereof the efficiency over time and under severe conditions is uncertain. Also, fracking often makes use of fluids at external ambient temperature whereas isolation devices are brought to the temperature of the well.

Expandable metal sleeves are less sensitive to temperature variations and more particularly to thermal contraction. The value of the coefficient of thermal expansion of the metal is lower than that of elastomer.

These expandable metal isolation devices therefore combine the advantages of devices explained earlier. First, as isolation devices based on inflatable elastomer, their design is simple and inexpensive and also they can be activated on demand as hydraulic isolation devices, soon after the completion has been run in the well.

Purely by way of illustration FIG. 1 illustrates a portion of pipe capable of being run in a well. This portion of pipe illustrated here is provided with two isolation devices 2 between which extends a portion of pipe 1 which presents a set of through openings 3.

This pipe 1 is illustrated again in the bottom part of the figure, the isolation devices 2 set in an expanded position.

The arrow v represents the circulation of fluid inside the pipe for fracking, that is, from upstream to downstream.

FIG. 2 is a simplified sectional view of the pipe such as that in FIG. 1, which extends into a previously prepared well.

The aim of the description of this figure is simply to explain how pipes provided with such zonal isolation devices has been used to date.

A well A whereof the wall is referenced $A_1$ has previously been drilled in the ground S.

Pipe 1 which is illustrated partially here has been set in place inside this well.

Along its wall, this pipe has, at regular intervals, isolation devices 2. In this case, just two devices 2 designated N and N-1 are illustrated by way of simplification.

In practice, there is a larger and substantial number of such devices along the pipe. As is known, each device is constituted by a tubular metallic sleeve 20 whereof the opposite ends are connected directly or indirectly to the external face of the pipe by reinforcing rings or skirts 21.

Pressure $P_0$ prevails in the well.

Initially, the metallic sleeves 20, not deformed, extend substantially in the extension of the rings 21.

The distal end of the pipe preferably comprises a port, not illustrated here, which is initially open during the descent of the pipe into the well so as to allow circulation of fluid from upstream to downstream at pressure $P_0$. This port is preferably closed by means of a ball which is placed in and blocks this port, increasing the pressure in the pipe is then possible.

A first fluid under pressure $P_1$ greater than $P_0$ is then sent inside the pipe. The fluid circulates through openings 10 arranged in front of the sleeves 20 along the entire pipe so as to expand the metallic sleeves and take the position of FIG. 2 in which their intermediate central part is in contact with the wall $A_1$ of the well.

Of course, the material of the sleeve and the pressure are selected so that the metal deforms beyond its elastic limit.

A device, not illustrated, frees up an opening located at the distal end of the pipe when the pressure $P_1$ is slightly raised. The pressure at the level of the opening goes from $P_1$ to $P_0$ and circulation is then possible in the pipe from upstream to downstream of the well.

Next, another ball 5 is launched inside the pipe and lands in a sliding seat 4 located substantially mid-distance between the two isolation devices N and N-1.

Originally, the seat 4 is located just opposite the above-mentioned openings 3 and seals them. Under the effect of displacement of the ball, the seat 4 is closed and shifts, freeing up the openings 3. A fracking fluid under very high pressure is then injected inside the pipe 1.

This fluid, under pressure $P_2$, is introduced in the device N as well as in the annular space B which separates the devices N and N-1.

However, the prevailing pressure inside the device N-1 returns to the initial pressure of the well, that is, to the pressure $P_0$.

In these conditions, the difference in pressure which exists between the annular space B and the device N-1 exposes the sleeve 2 of the device N to high stresses which in some places leads it to partially collapse. It is understood that this constitutes a source of leaks, meaning that the zone B to be fracked is no longer fluid or gas tight.

Systems have been added to this kind of devices to withstand collapse. An example is given in document WO 2011/042492. Another option is to use this pressure difference by way of valves to maintain internal pressure in the device after expansion or to "capture" this pressure difference (see U.S. Pat. No. 7,591,321, U.S. Publication No. 2006/004801 and U.S. Publication No. 2011/0266004). Yet, all these solutions mean greater complexity of the material and risk of malfunctioning.

From EP-A-1 624 152 is known a device in which each sleeve of the pipe is equipped with a "skin" which extends only along a part of said sleeve. Between the sleeve and the skin is present a sealant material.

BRIEF SUMMARY OF THE INVENTION

The aim of the present invention is to cope with these difficulties.

More specifically, it relates to an isolation device of part of the well which is capable of resisting high differential pressures while having considerable sealing capacity.

Also, the system according to the invention has expansion pressure less than the fracking pressure and is not sensitive to changes in temperature.

As a result, this isolation device of part of a well which comprises a pipe provided along its external face with at least one metallic tubular sleeve-called "first external sleeve" —whereof the opposite ends are connected directly or indirectly to said external face of the pipe. This pipe, the first external sleeve and its ends together delimiting an annular space, the wall of said pipe exhibiting at least one opening which allows it to communicate with said space, this sleeve being likely to expand and to be applied tightly against the wellbore over an intermediate part of its length is characterised in that it comprises:

- on the one hand, a second sleeve also expandable-called "second internal sleeve"—which extends between said pipe and the first sleeve, its ends being also connected directly or indirectly to the external face of said pipe, while being sandwiched between the ends of the first sleeve and the external face of the pipe,
- on the other hand, at least one communication passage between the exterior of the first sleeve and said space,
- said space being free of solid or sealant material, or of a liquid or paste which solidify.

The solution according to the invention succeeds in establishing pressure inside isolation devices, substantially equal to that which allows fracking of the rock, without the concern of collapsing and sealing leaks. Also, the solution according to the invention does not affect the general structure of pipe equipped with known isolation devices.

According to other advantageous non-limiting characteristics:

- said communication passage consists of at least one orifice presented by the wall of said first metallic sleeve and which terminates in the part of said space which extends between the two sleeves;

said communication passage consists of at least one orifice located between two of the opposite ends of the sleeves and which terminates in the part of said space between the two sleeves;

said opening presented by the wall of the pipe terminates in the part of said space located between the pipe and the second sleeve;

said communication passage between the exterior of the first sleeve and said space consists of at least one orifice located between the pipe and the end in front of said second sleeve and terminates in the part of said space located between the pipe and the inner sleeve;

said opening presented by the wall of the pipe terminates in the part of said space which extends between the two sleeves;

said opening of the pipe communicates with said space via an annular space which extends between the first ends opposite the first sleeve and the second sleeve;

said second sleeve is made of material capable of plastic deformation, such as metal and/or elastically deformable material such as rubber or material based on rubber;

the external face of the sleeve is provided, at least in said intermediate part, with an elastically deformable sealing cover, for example made of rubber;

it comprises a non-deformable ring which envelops, over a fraction of its length, said first sleeve and which at least partially limit its expansion and that of the second sleeve;

the external face of the pipe comprises, opposite said at least one communication opening between the pipe and said space, an elastically deformable cover, said at least one opening extends opposite a connecting skirt of the first sleeve on said pipe;

said at least one opening extends opposite said non-deformable ring;

at least one end of said sleeves is capable of moving longitudinally relative to the pipe.

Other characteristics and advantages of the present invention will emerge from the following detailed description of some preferred embodiments. This description will be given in reference to the attached drawings, in which:

DETAILED DESCRIPTION

Figure 1:
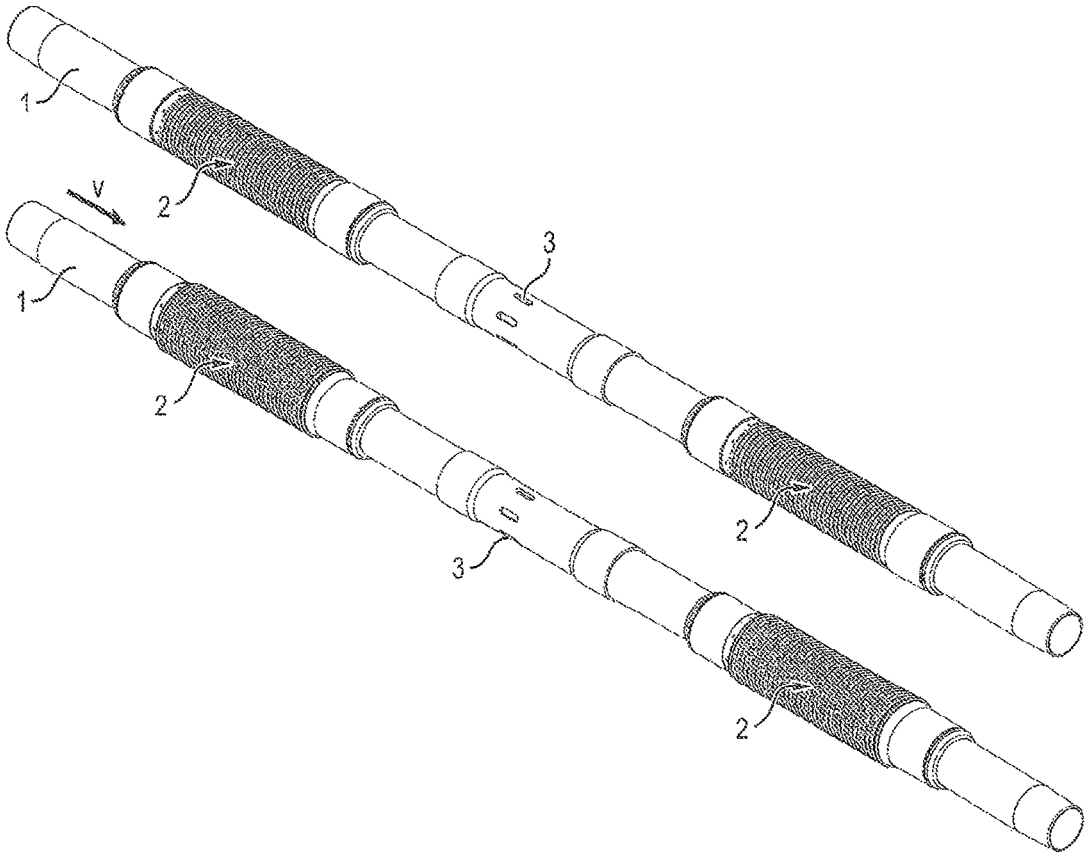
FIG. 1 shows, as indicated hereinabove, a portion of pipe according to the prior art and given that, visually, that of the present invention has substantially the same appearance.
Figure 2:
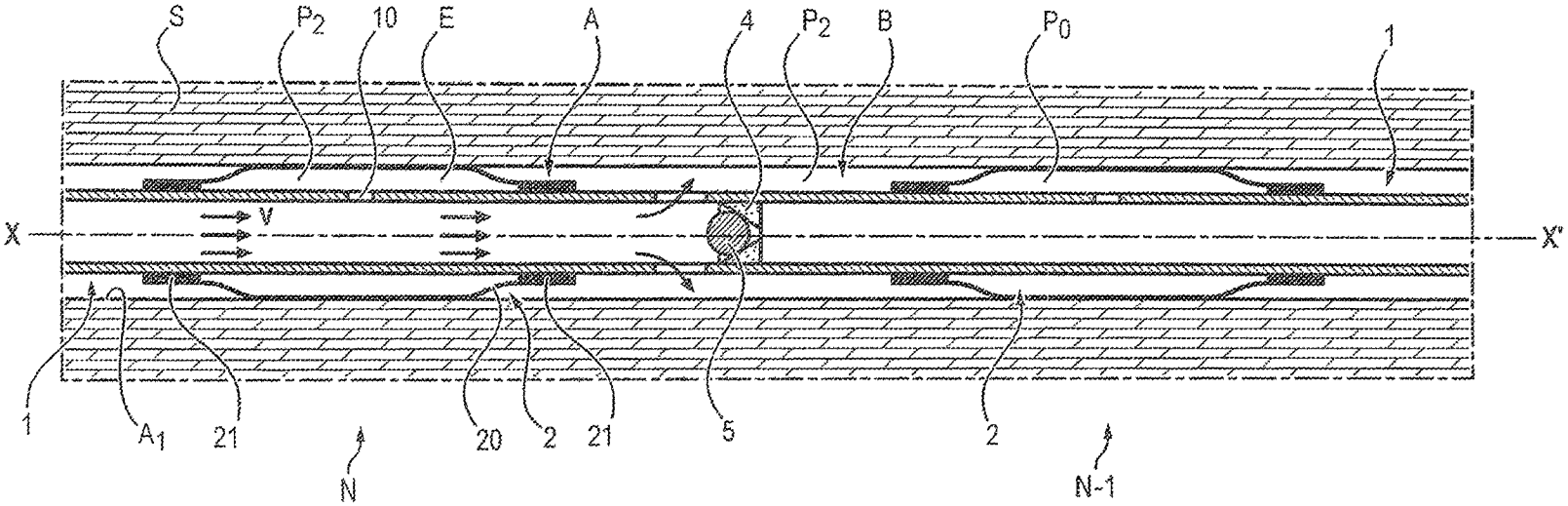
FIG. 2 is, as explained hereinabove, a sectional view of part of pipe intended to illustrate methods used to date.
Figure 3:
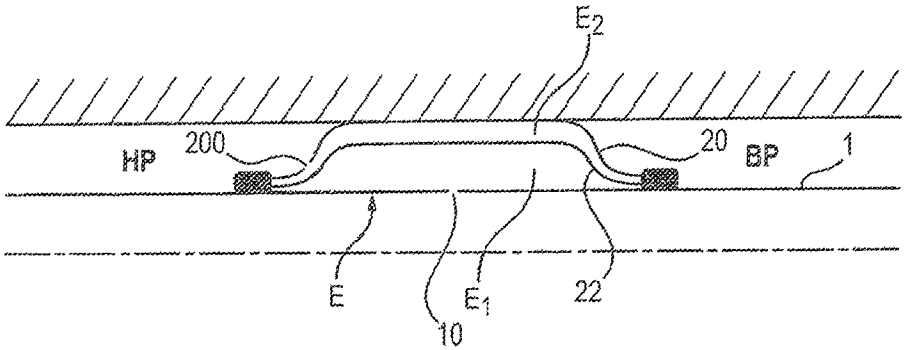
FIG. 3 is a semi-view, in longitudinal and extremely simplified section, of a first embodiment of the invention.
Figure 4:
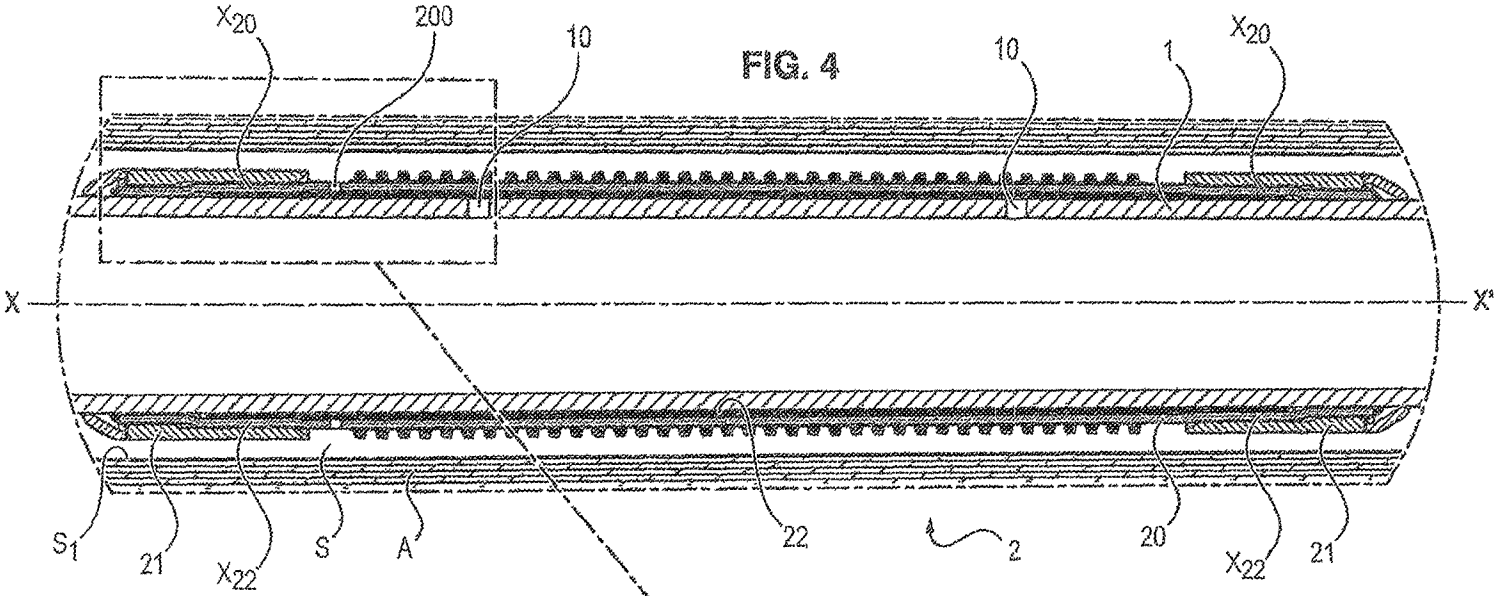
FIG. 4 is a more detailed sectional view, according to a longitudinal plan of the embodiment of FIG. 3.

In reference to FIGS. 3 and 4 (in which the same reference numerals designate the same items), only a portion of pipe 1 in place in a well A is illustrated, and the portion of pipe which is provided with the isolation device referenced N-1 in FIG. 2 is illustrated in particular.

It is illustrated expanded in FIG. 3 and not expanded in FIG. 4.

As illustrated in FIG. 3, the device isolates an annular part of the well where high pressure HP prevails (hereinbelow designated $P_2$) from another annular part, located downstream, where low pressure BP (hereinbelow designated $P_0$) prevails.

More particularly in reference to FIG. 4 and as is well known, this tubular pipe is provided along its external face with a metallic sleeve 20 whereof the opposite ends $X_{20}$ are solid with the external face of this pipe.

More precisely, these ends are enclosed inside reinforced annular rings referenced 21 in FIG. 4.

Figure 5:
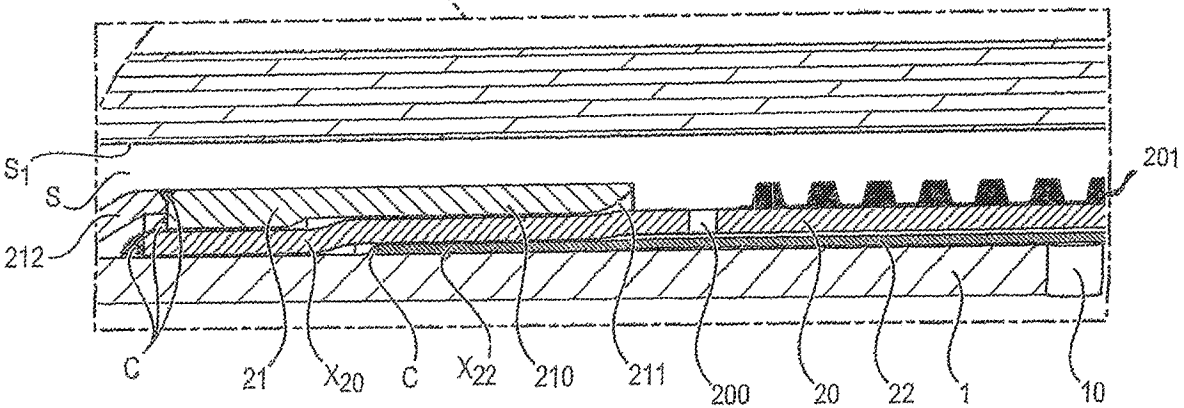
FIG. 5 is an enlarged view of the part of FIG. 4 shown in the form of a rectangle.

In referring more particularly to FIG. 5, it is evident that the external face of the metallic tubular sleeve 20 is provided with a grooved cover 201, for example made of rubber, capable of boosting sealing of the sleeve when the latter is deformed and is compressed against the well A.

It is evident more particularly from FIGS. 3 and 5 that there is at least one orifice 200 through the thickness of the wall of the sleeve 20; its function will be explained later.

According to a particular characteristic of the invention, this is about a second sleeve 22, also expandable, whereof the ends $X_{22}$ are sandwiched between those of the first sleeve 20 and the external face of the pipe 1, as shown in FIGS. 4 and 5.

In the case illustrated here, the two sleeves are made of ductile metallic material. However, the second internal sleeve 22 could be made of another expandable material such as an elastically deformable material based on rubber.

FIG. 5 shows that the ends $X_{22}$ of the second internal sleeve 22 are located under part of the wall of the first external sleeve 20, the latter exhibiting greater length longitudinally.

These sleeves are fixed to the wall of the pipe 1 by welds.

The same applies to the two parts 210 and 212 which constitute respectively the body and the end of the skirt or reinforcing ring 21.

Fixing means other than welds can be used, of course.

Figure 6:
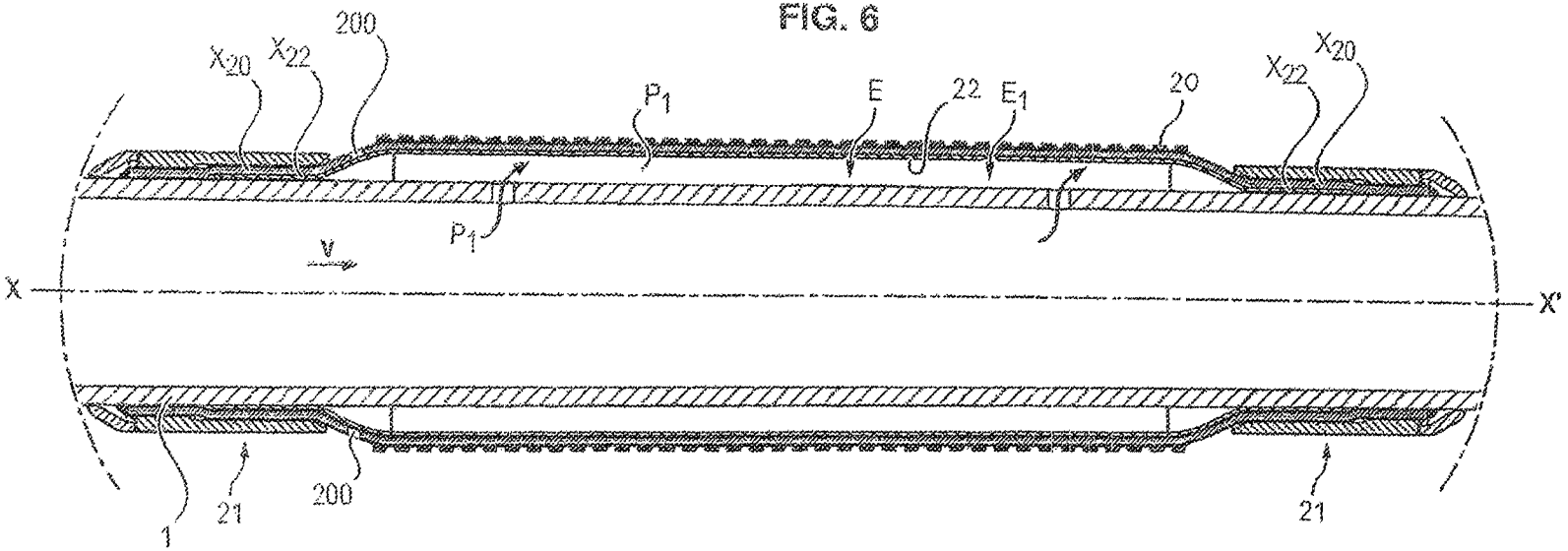
FIGS. 6, 7 and 8 are views of the portion of pipe in different states which are a function of the pressure and nature of fluids circulating in the pipe.
Figure 7:
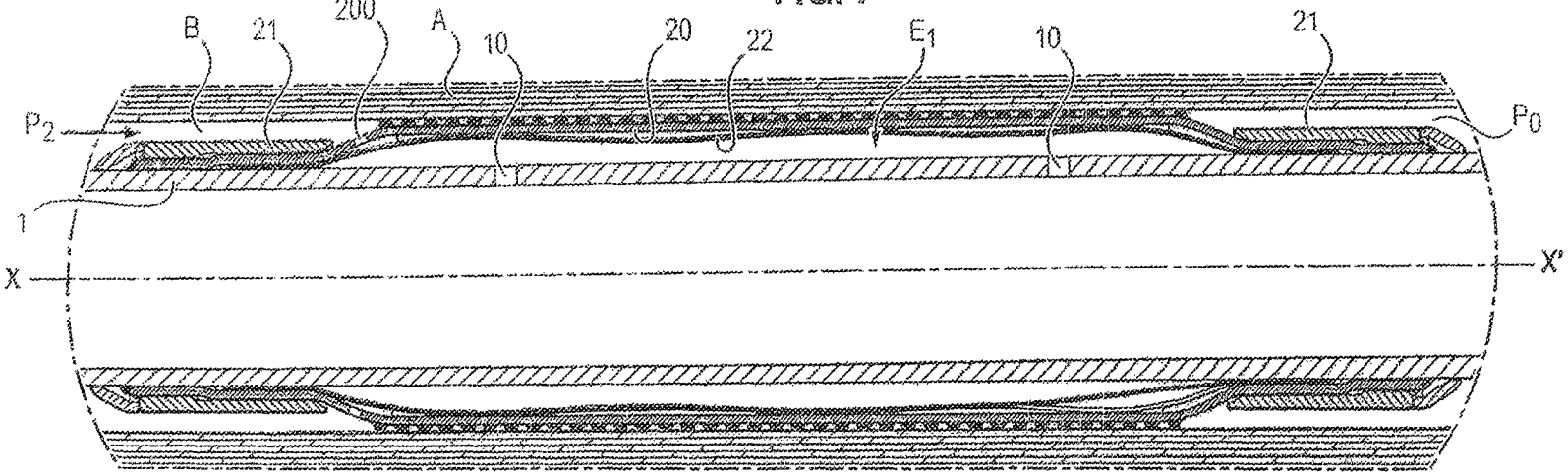
Figure 8:
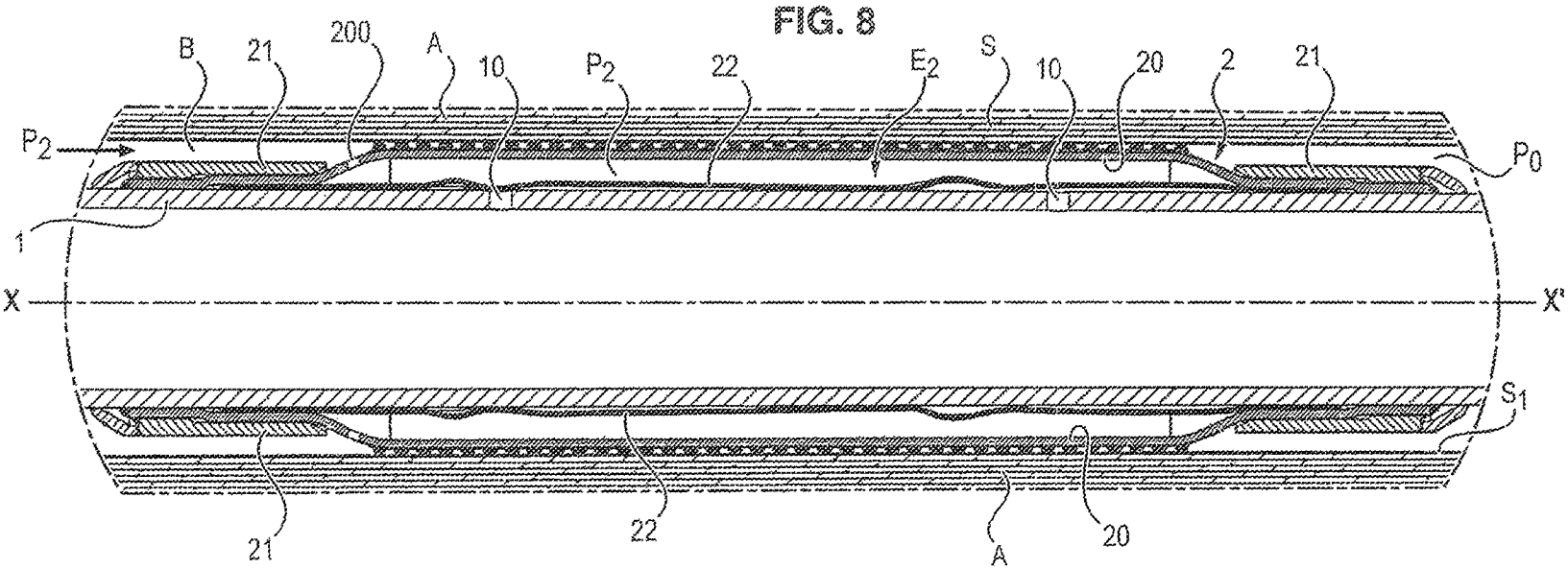

More particularly in reference to FIGS. 6 to 8, there will now be a description of how such an isolation device of part of a well is used.

FIG. 6 shows a situation in which the openings 3 of the pipe 1 are closed and a fluid under preset pressure $P_1$ is injected in the direction of the arrow v. This pressure is calculated to allow deformation of the first external sleeve 20 beyond its elastic limit, and can be of the order of 550 Bar (around 8000 psi).

In the process, the fluid enters the space E which is delimited by the wall of the pipe 1, the first external sleeve 20 and its ends $X_{20}$.

This space E is divided into two parts, in this case a space $E_1$ delimited by the pipe 1 and the second sleeve 22, and a space $E_2$ delimited by the two sleeves.

In any case, according to the invention, the space E (i.e spaces $E_1$ and $E_2$) is not intended to be filled with a solid material or a liquid or paste material which becomes solid thereafter, or with a sealant material.

The second sleeve 22 has expansion pressure which is less than or equal to $P_1$, that is, it is capable of expanding under the effect of pressure less than or equal to $P_1$.

Because the second internal sleeve 22 is sandwiched in between the first sleeve 20 and the pipe 1, the second sleeve 22 deforms and is pressed against the inner face of the first sleeve 20.

Under the effect of the pressure $P_1$, the sleeves 20 and 22 deform therefore simultaneously radially towards the exterior, as shown in FIG. 6, and the first sleeve 20 is pressed against the well.

After expansion of the sleeves, the pressure drops and returns to $P_0$. This pressure $P_0$ is applied therefore in the space $E_1$ located between the pipe 1 and the second inner sleeve 22. At this instant $E_1$ is substantially equal to E, approximately the thickness of the second sleeve 22.

This is the situation of FIG. 6.

In a later step, the openings 3 are cleared and a fluid under fracking pressure $P_2$, above $P_0$ (and $P_1$), is circulated in the pipe 1.

This fluid therefore occupies the annular space B which separates both adjacent isolation devices and, as shown in FIG. 7, the prevailing pressure $P_2$ is communicated inside the space E via the orifices 200 presented by the external sleeve 20.

In this way, the space $E_1$ which is located between the pipe 1 and the second sleeve 22 sees its volume reduce gradually since said pressure is sufficient to deform this second sleeve and press it progressively against the pipe 1. There is progressive transition from the situation of FIG. 6 to that of FIG. 8.

In the process, on either side of the first external sleeve 20, the same equalised pressure $P_2$ is obtained. In these conditions, sealing is retained and the risk of collapse of the sleeve is no longer there.

This solution is particularly advantageous since no mobile mechanical member is necessary. The only necessary step is to provide a second sleeve 22 and orifices 200 in the first sleeve 20.

Figure 9:
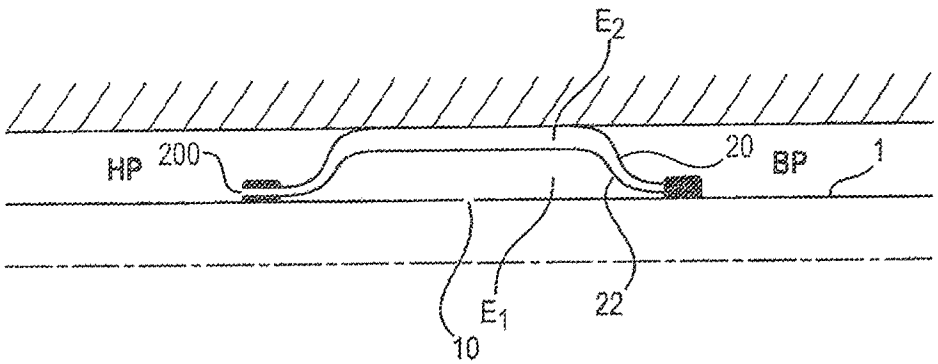
FIGS. 9 and 10 are views similar to FIG. 3 of other embodiments.
Figure 10:
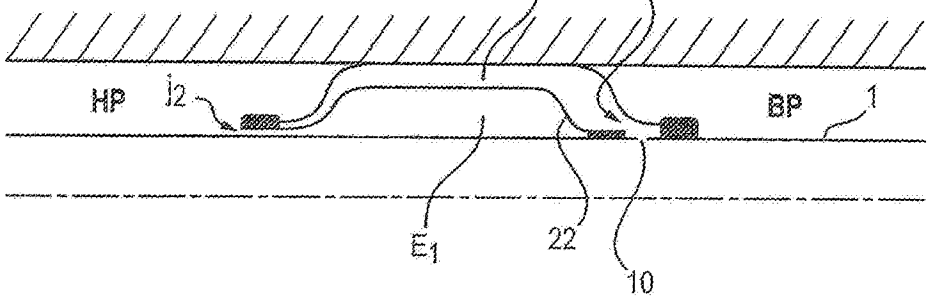

The embodiment illustrated highly schematically in FIG. 9 relates substantially to the same structure as that described previously if the only difference is the orifice 200 (or the orifices) not being located in the wall of the sleeve 20, but between one of the two ends opposite sleeves 20 and 22.

However, the operation described hereinabove applies also for this embodiment, if the only difference is the pressure $P_2$ being initiated between the two sleeves via the abovementioned orifice(s) located between the ends of the two sleeves.

The embodiment illustrated in FIGS. 10 to 14 also deals with a structure having two sleeves 20 and 22.

However, the external sleeve 20 is devoid of orifices 200.

However, the openings 10 which connect the pipe 1 with the abovementioned space E communicate with the latter via an annular gap $j_1$ which extends between the first end of the first sleeve 20 and the first end of the second sleeve 22. This is particularly evident in FIGS. 10 and 12.

To do this, the sleeve 20 has been previously deformed locally to release such a gap.

Figure 11:
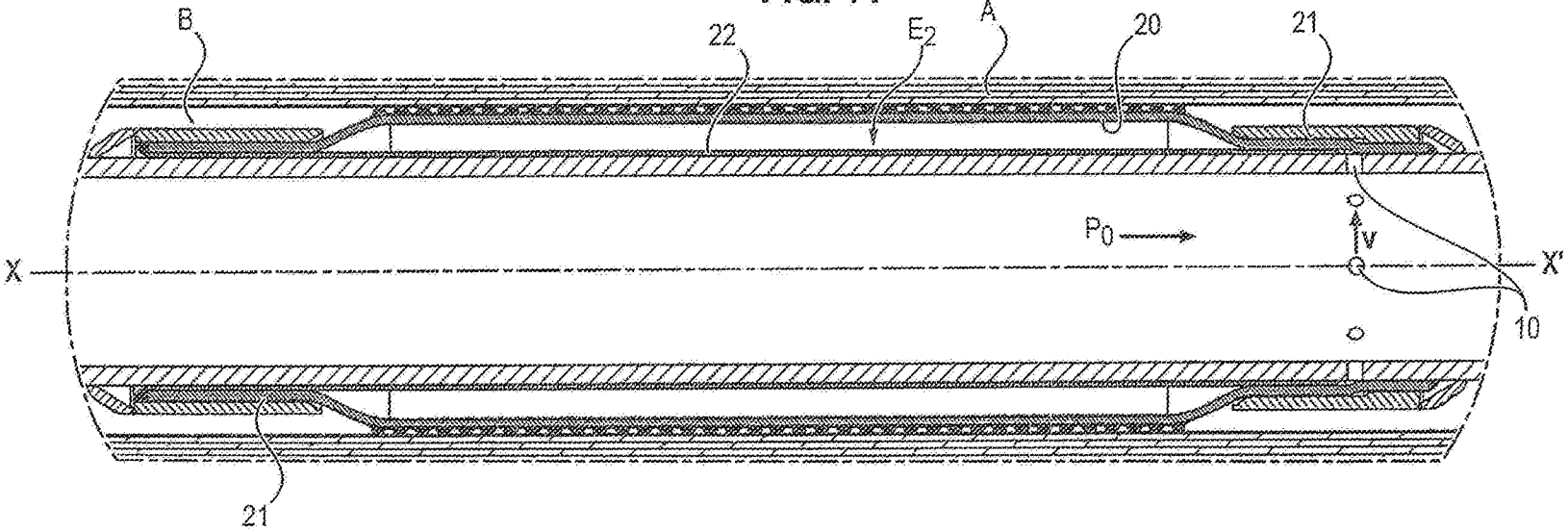
FIG. 11 is a more detailed view, in longitudinal section, of the embodiment of FIG. 10.
Figure 12:
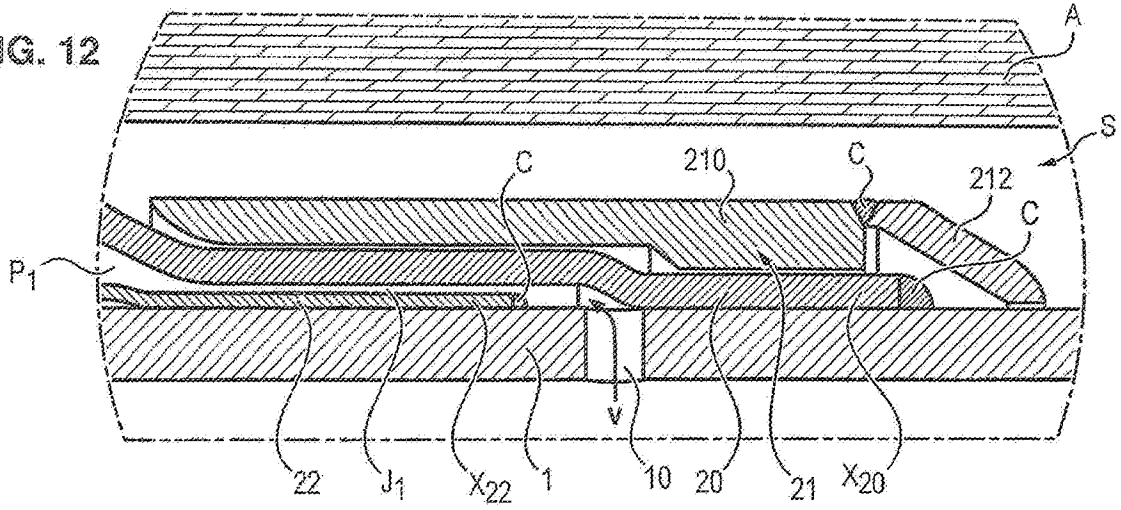
FIGS. 12 and 14 are views of opposite ends of the metallic sleeve of the embodiment of FIG. 10.

Under the effect of the introduction of initial pressurised fluid $P_1$ to the pipe, the openings 3 being closed, the fluid infiltrates via the openings 10 and travels in the annular gap $j_1$ to occupy the space $E_2$ located between the two sleeves 20 and 22, as in the configuration of FIG. 11.

Figure 14:
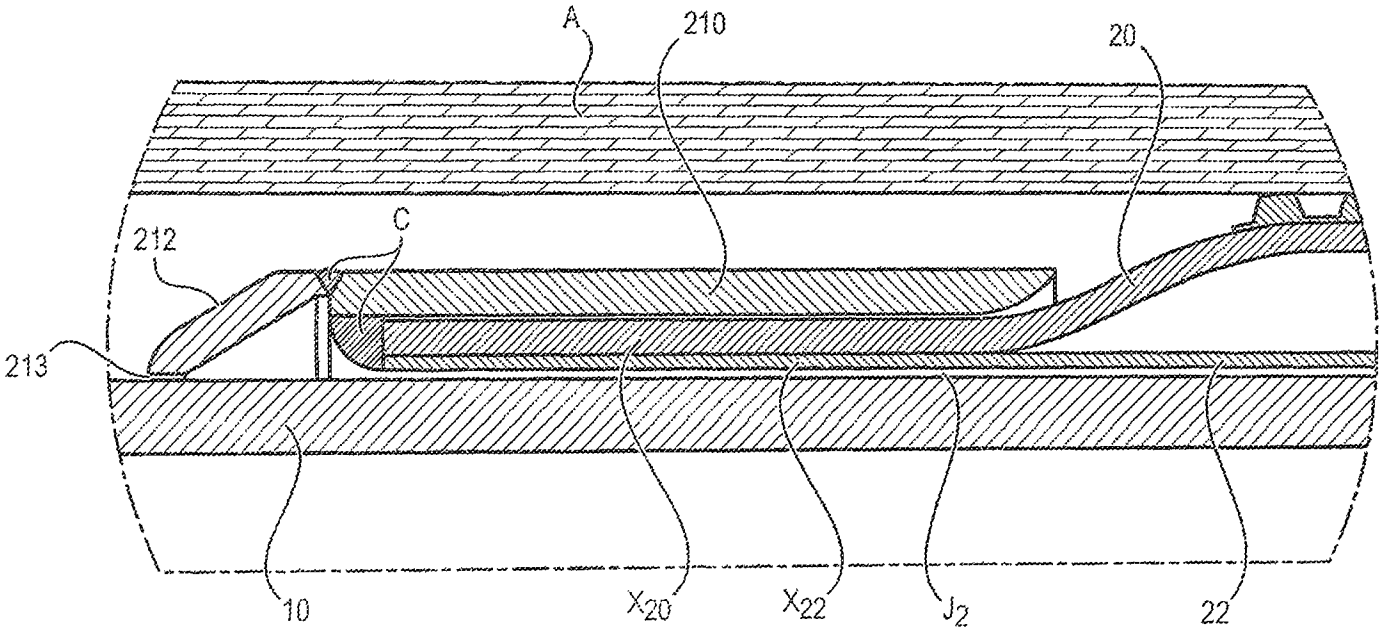

In reference to FIG. 14, it is evident, at the other end of the sleeves, that the reinforcing ring or skirt 21 is not sealed tightly, and for this reason has an opening 213. However, the corresponding ends $X_{20}$ and $X_{22}$ of the two sleeves 20 and 22 are jointed together and welded to the body 210 of the skirt 211. But this leaves a gap $j_2$ between the inner face of the second sleeve 22 and the wall of the pipe 1.

In these conditions, the fluid of pressure less than or equal to $P_2$ can travel in the gap $j_2$ and deform the second sleeve 22 which is applied tightly against the first sleeve 20.

Figure 13:
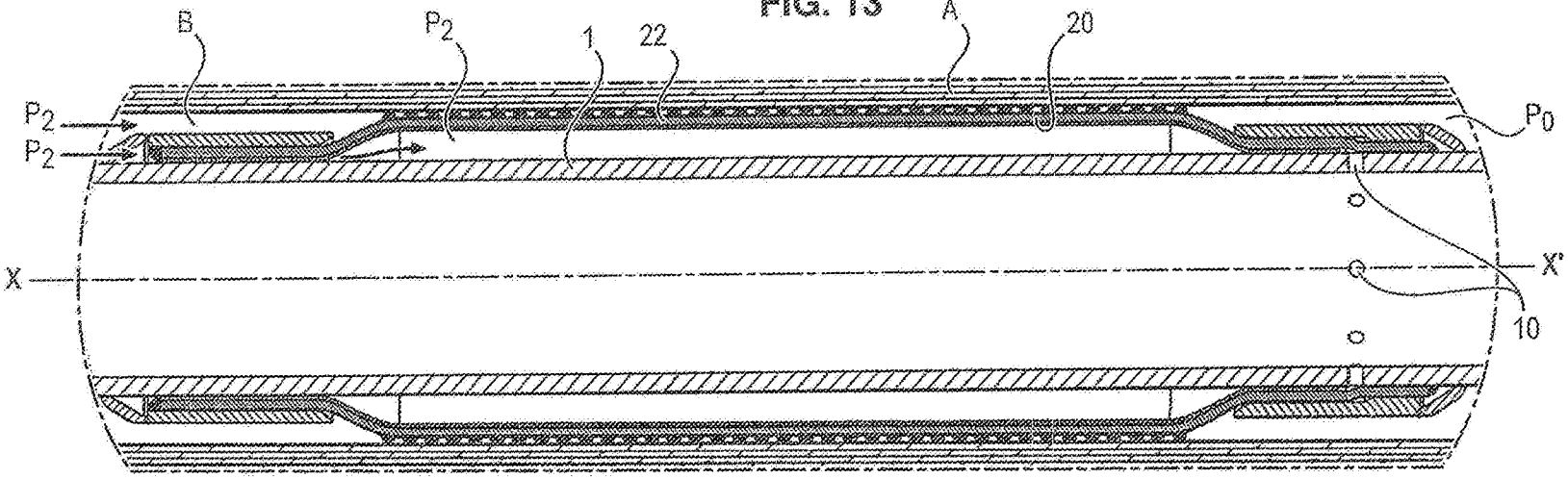
FIG. 13 is a view of another step relative to utilisation of this pipe.

This gives the configuration of FIG. 13 where there is equalising pressure $P_2$ inside and outside the isolation device.

In this way, any risk of even partial collapsing of the device 2 is guaranteed.

Figure 15:
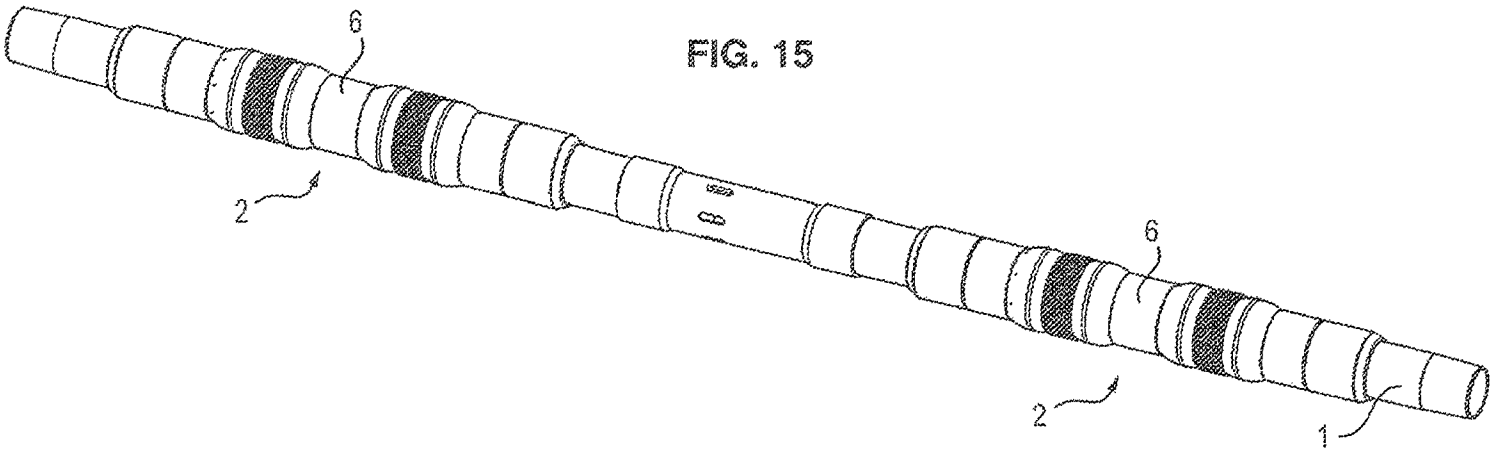
FIG. 15 is a three-dimensional view of another particular embodiment of the pipe.

FIG. 15 illustrates a variant of pipe whereof the two isolation devices 2 are each provided with a non-deformable ring 6, which partially and locally limits the expansion of the sleeves 20 and 22.

Figure 16:
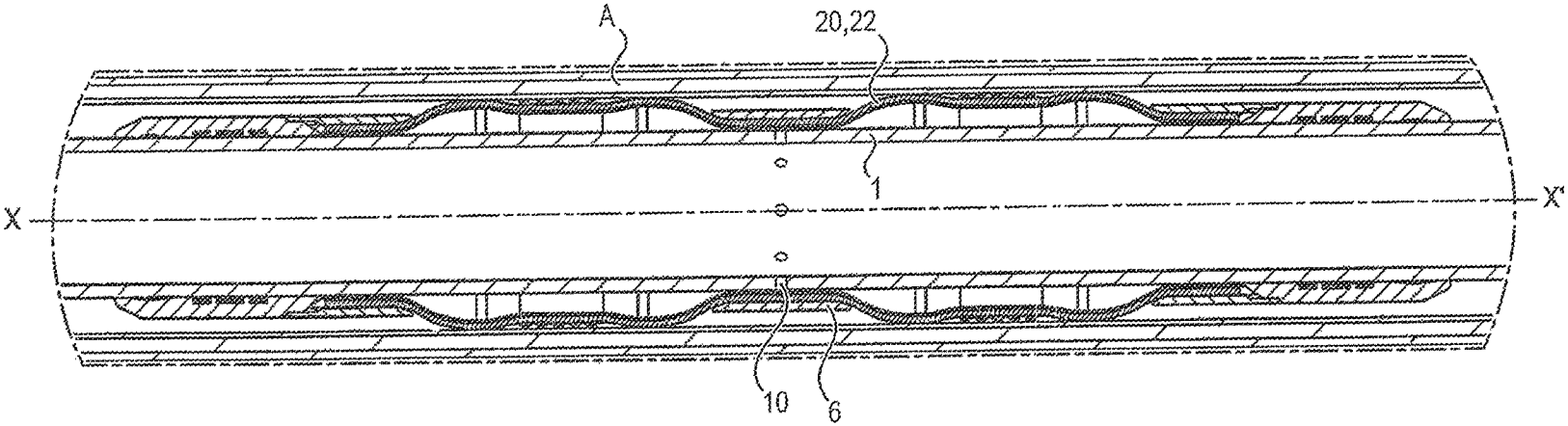
FIGS. 16 and 17 represent both a portion of this pipe of longitudinal sectional view and respectively a view of a detail of this portion, specifically that which is enclosed by an oval in FIG. 15.
Figure 17:
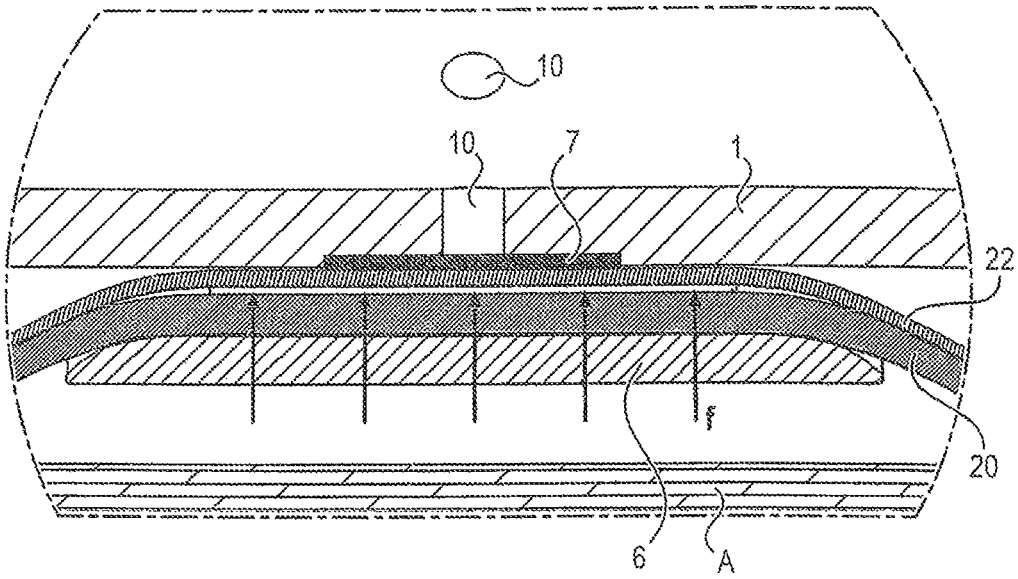

As is shown more particularly by the sectional view of FIG. 16, this ring 6 is located opposite the zone where the pipe is provided with communication openings 10 between the interior of the pipe 1 and the space E.

According to an advantageous characteristic of the present invention, the external face of the pipe 1 comprises a deformable elastic cover 7, for example made of rubber which covers the openings 10.

This can be a single and same tubular piece which covers all the openings 10 or several different pieces each covering an opening.

This cover is attached only at some points to the sleeve, for example by adhesion. So when this relates to a pressure flow directing openings 10 in the direction of the cover 7, the latter releases the pressure in the regions where it is not attached to the pipe 1.

The external sleeve 20 presented here is of the same type as that of FIG. 3 and following, such that it comprises at least one through orifice 200.

As is evident earlier, when the pressure $P_2$ enters the space $E_2$ collapsing of the sleeve 22 occurs.

During this collapsing, folds generated in the material of the sleeve can constitute mechanical weak zones and sources of leaks.

But if the device according to the invention is reused several times, the expansion and collapsing phases of the sleeve 22 risk making it defective.

Figure 18:
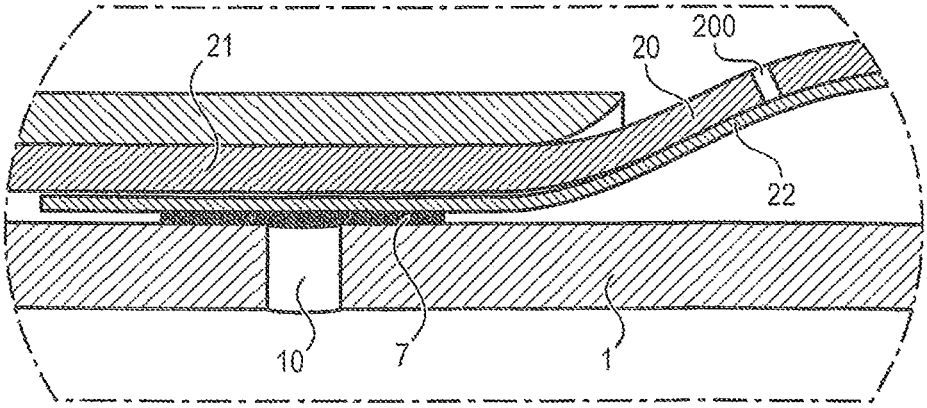
FIG. 18 finally is a view of a variant of the embodiment of FIG. 17.

In the embodiment of FIG. 18, the openings 10 and their associated cover 7 are located in the region of the ends of the sleeves 20 and 22. In this way, in this region and under the effect of $P_2$, the sleeve 22 diminishes slightly in diameter and exerts pressure on the cover 7, accordingly closing the openings 10.

The pressure $P_2$ is applied in the space $E_1$ which further still limits the risk of collapsing.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An isolation device of part of a well which comprises a pipe having at least one metallic tubular sleeve on an external face thereof, which forms a first external sleeve, wherein opposite end portions of the first external sleeve are connected directly or indirectly to said external face of the pipe, the pipe, the first external sleeve, and the first external sleeve's end portions jointly delimiting a first space therebetween, a wall of said pipe exhibiting a first opening which allows it to communicate with said first space, the first external sleeve being configured for expansion and application tightly against the well over an intermediate part of a length of the first external sleeve, wherein the isolation device comprises:

a second expandable internal sleeve, which extends between said pipe and the first sleeve, wherein end portions of the second sleeve are connected directly or indirectly to the external face of said pipe, while being sandwiched between the end portions of the first sleeve and the external face of the pipe, a second opening communicating with the exterior of the first sleeve and a second space located between said pipe and said second internal sleeve, said first and second spaces being free of solid or sealant material, or of a liquid or paste which is configured to solidify, said first opening communicating with a third space located between said first external sleeve and said second internal sleeve.

2. The device as claimed in claim 1, wherein said second sleeve is made of material capable of exhibiting plastic deformation.

3. The device as claimed in claim 1, wherein an external face of the first sleeve is provided, at least in said intermediate part, with an elastically deformable sealing cover.

4. The device as claimed in claim 1, wherein the device comprises a non-deformable ring which envelops, over a fraction of its length, said first sleeve and which at least partially limits said first sleeve's expansion and that of the second sleeve.

5. The device as claimed in claim 1 wherein the external face of the pipe comprises an elastically deformable cover opposite said at least one opening between the pipe and said space.

6. The device as claimed in claim 5, wherein at least one opening extends opposite a skirt connecting the first sleeve to said pipe.

7. The device as claimed in claim 4, wherein at least one opening extends opposite said non-deformable ring.

8. The device as claimed in claim 1 wherein at least one of the end portions of said first and second sleeves is capable of moving longitudinally relative to the pipe.

9. The device as claimed in claim 2, wherein said material capable of exhibiting plastic deformation is a metal and/or elastically deformable material consisting of rubber or a material based on rubber.

10. The device as claimed in claim 3, wherein said deformable sealing cover is made of rubber.

11. The device as claimed in claim 1, wherein said first opening includes a valve configured to trap fluid inside said first space.

12. The device as claimed in claim 11, wherein said valve is configured to close when pressure reaches a predetermined value in said second space.

* * * * *